US008206007B2

(12) United States Patent
Lynn

(10) Patent No.: US 8,206,007 B2
(45) Date of Patent: Jun. 26, 2012

(54) VIBRATING LED LIGHTING DEVICE

(76) Inventor: Richard Charles Lynn, Portland, OR (US)

( * ) Notice: Subject to any disclaimer, the term of this patent is extended or adjusted under 35 U.S.C. 154(b) by 623 days.

(21) Appl. No.: 12/378,134

(22) Filed: Feb. 10, 2009

(65) Prior Publication Data

US 2010/0202139 A1 Aug. 12, 2010

(51) Int. Cl.
*F21S 4/00* (2006.01)
*F21V 21/116* (2006.01)

(52) U.S. Cl. ..... 362/249.16; 362/249.02; 362/249.06; 362/249.09; 362/249.14

(58) Field of Classification Search ..... 362/565, 362/231, 249.02, 249.03, 249.06, 249.07, 362/249.09, 249.1, 249.14, 249.16, 800
See application file for complete search history.

(56) References Cited

U.S. PATENT DOCUMENTS

| | | | | |
|---|---|---|---|---|
| 1,718,499 | A * | 6/1929 | Thomas | 84/464 R |
| 3,368,215 | A * | 2/1968 | Clement | 362/35 |
| 3,477,157 | A * | 11/1969 | Paquette | 40/432 |
| 3,707,790 | A * | 1/1973 | Jaffe, Jr. | 40/433 |
| 5,041,947 | A * | 8/1991 | Yuen et al. | 362/35 |
| 6,452,575 | B1 * | 9/2002 | Lin | 345/31 |
| 6,819,056 | B2 * | 11/2004 | Lin | 315/185 S |
| 6,851,208 | B2 | 2/2005 | Carter | |
| 6,923,548 | B2 * | 8/2005 | Lim | 362/612 |
| 6,932,495 | B2 * | 8/2005 | Sloan et al. | 362/294 |
| 7,140,751 | B2 * | 11/2006 | Lin | 362/249.02 |
| 7,766,718 | B2 * | 8/2010 | Rago et al. | 446/242 |
| 2003/0063463 | A1 * | 4/2003 | Sloan et al. | 362/238 |
| 2004/0004828 | A1 * | 1/2004 | Chernick et al. | 362/35 |

* cited by examiner

*Primary Examiner* — Ismael Negron
(74) *Attorney, Agent, or Firm* — Mark S. Hubert

(57) ABSTRACT

A wand attached to an eccentrically weighted motor randomly vibrates the wand. An LED cluster including blue, red, and green LEDs is coupled to an end of the vibrating wand for providing a visual display of blue, violet, red, yellow, green and white light.

12 Claims, 11 Drawing Sheets

LED ORIENTATION

SOLDERED AT ADJOINING CORNERS

WIRES SOLDERED AT LED ENDS

CEMENT FILLS SPACE AND COVERES ALL BUT LIGHT EMITTERS

VIBRATING LED LIGHTING DEVICE

BACKGROUND OF THE INVENTION

The present invention relates generally to a decorative lighting device. More particularly, the present invention relates to a light emitting diode (LED) device designed to whimsically simulate the movement and bioluminescence of any number of luminescent beetles, commonly referred to as "fireflies" or "lightening bugs" in North America.

Often visible on summer evenings, fireflies enthrall children and elicit a nostalgic feeling in adults. Fireflies simply inspire a collective feeling of backyard nature at its best.

Located under their abdomens, fireflies have dedicated organs, in which a complex chemical reaction occurs, to produce their signature glow. Firefly light is usually intermittent, and since the insect continues to fly between flashes, there is no discernable pattern of light emission.

In an attempt to mimic the randomness of a firefly's flashing and the movement of their flight, prior art products use miniature fan assemblies to blow wire leads with an LED attached. The effect is of a small LED simply being blown around.

SUMMARY OF THE INVENTION

In a whimsical firefly simulation embodying the principle of the invention achieves the random, fanciful flutter of the fireflies' flight through the use of the vibrating wand. In combination with the vibrating wand, a novel arrangement and assembly of an LED cluster allows for a visual display of blue, violet, red, yellow, green, and white light to simultaneously be generated.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements. Other objects, features and aspects of the present invention are discussed in greater detail below.

DETAILED DESCRIPTION

Figures 1, 1A:
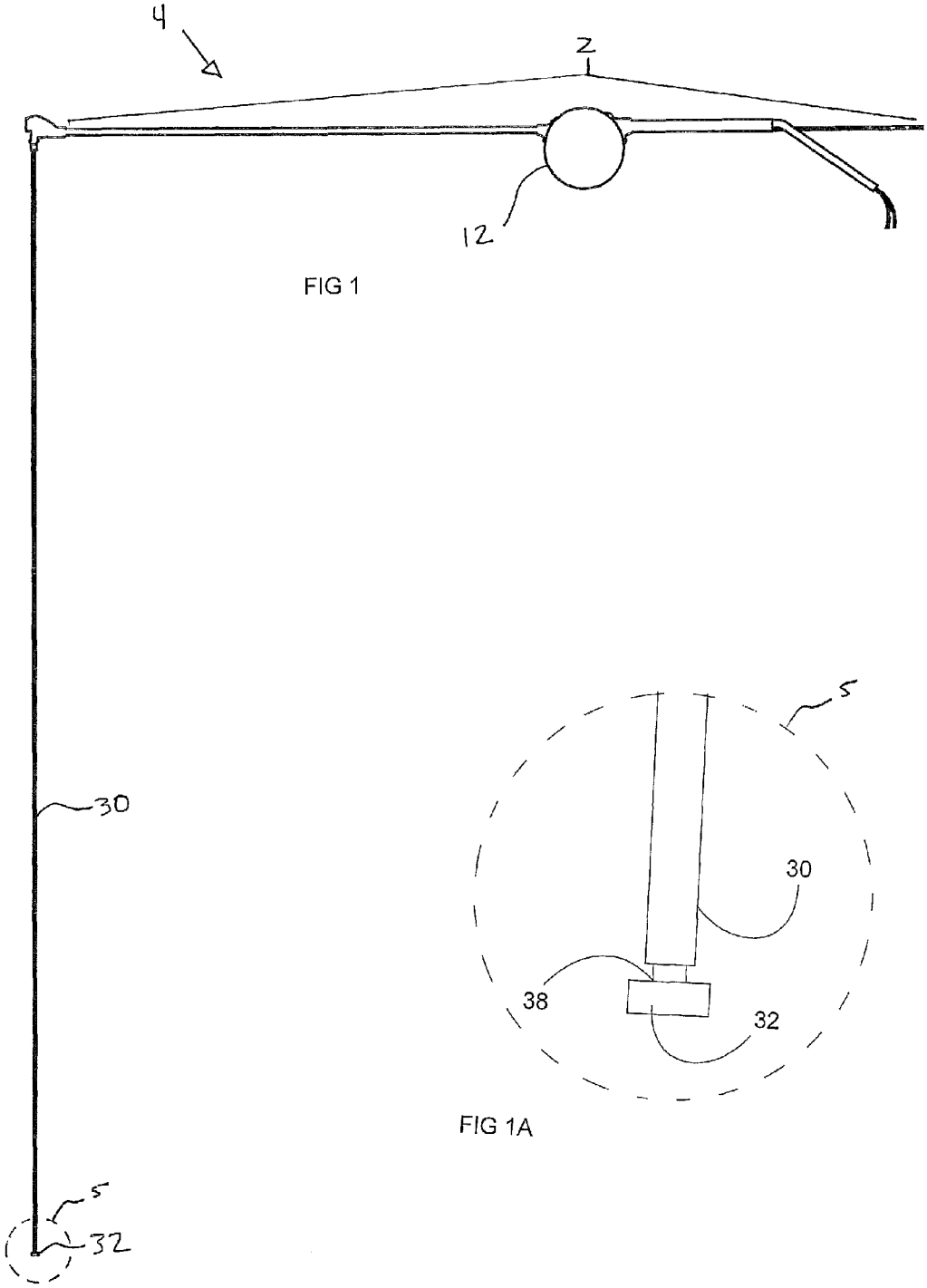
FIG. 1 is a side view of an embodiment of the firefly simulation device.
FIG. 1A is an enlarged side view of the LED cluster and cable as indicated by the dashed circle from FIG. 1.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Figure 4:
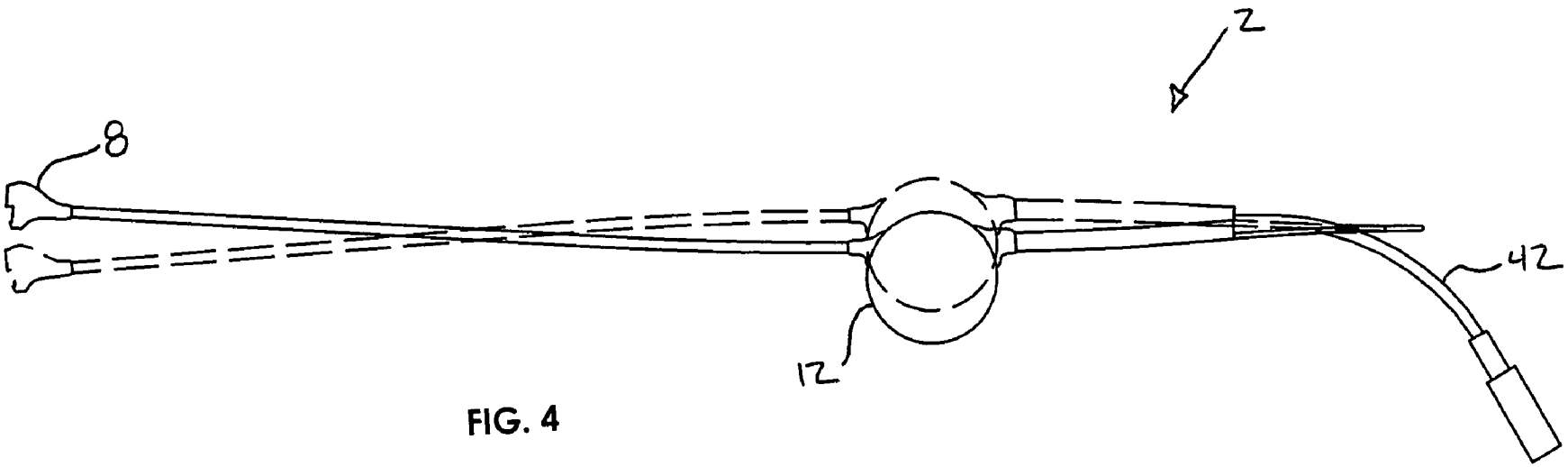
FIG. 4 is a side view of the wand vibrating.

FIG. 1 illustrates a side view of an embodiment of wand 2 of the whimsical firefly simulation device 4 comprising a wand 2, a housing 12 for storing the motor and electronics (not visible), an LED cable 30, and an LED cluster 32. At night, or in an environment with dim ambient lighting, operation of the whimsical firefly simulation device 4 causes the wand 2 to vibrate biaxially (See FIG. 4) and LED cable 30 to jerk and swing randomly, appearing to the observer as a confused, randomly convulsing, multi-colored firefly.

Figure 2:
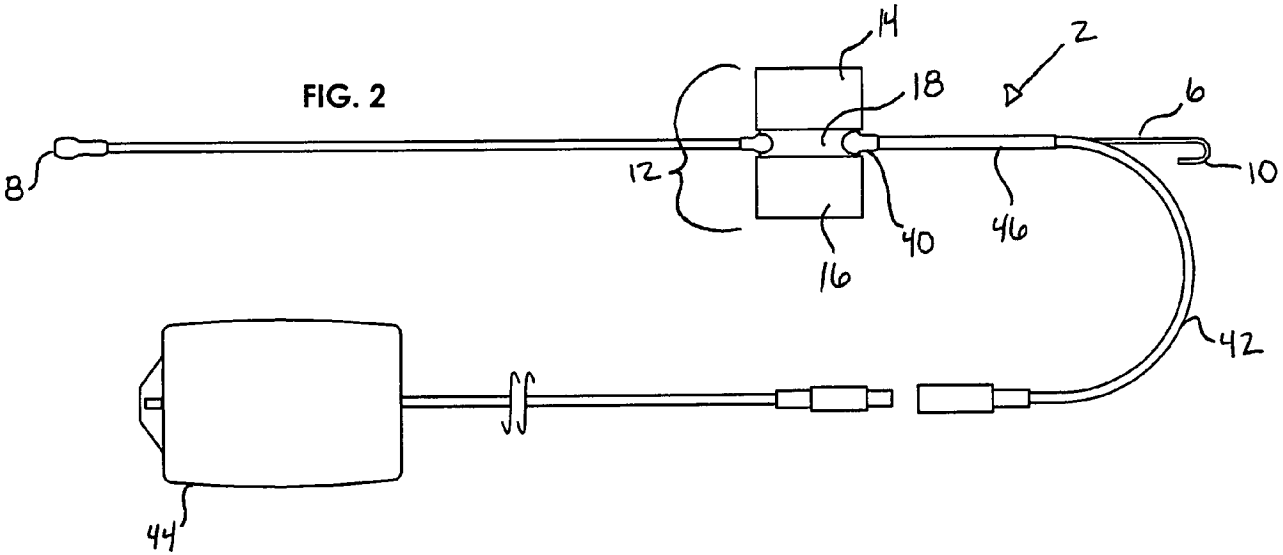
FIG. 2 is a top view of an embodiment of the wand.
Figure 3:
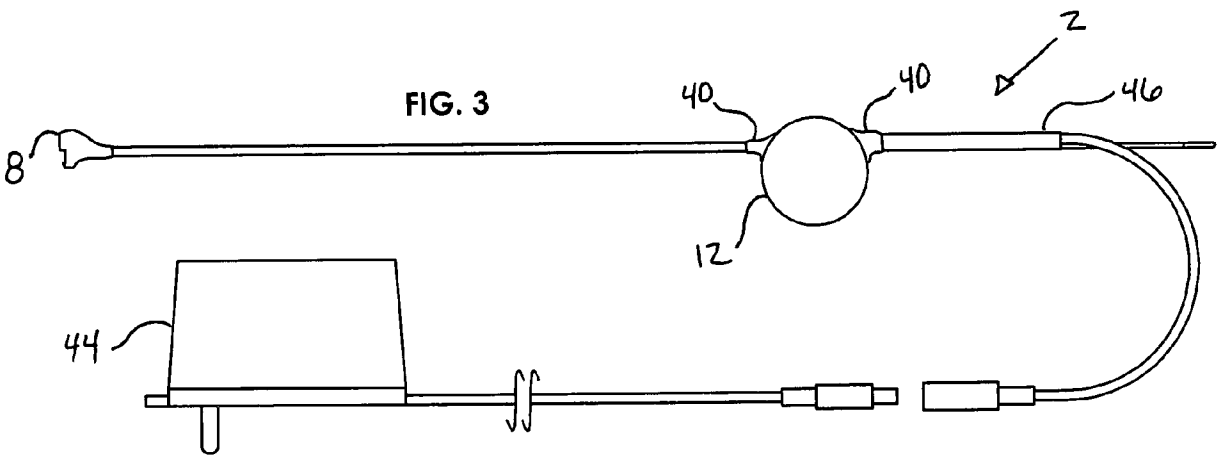
FIG. 3 is a side view of an embodiment of the wand.

FIGS. 2 and 3. illustrate a top view and side view of an embodiment of the wand 2, respectively. Wand 2 includes rod 6, terminating at an quick connect electrical coupling (2-pin MTA socket) 8 at its first end, and a mounting means 10 at its opposite end. Located at approximately the ⅔ point of rod 6 (when moving from left to right across the rod 6) is a dual-compartment housing 12. Housing 12 is mounted on rod 6, and chemically secured to rod 6 via an epoxy 40 along its midline 18 such that a first compartment 14 and second compartment 16 reside opposite one another along rod 6 as is visible in FIG. 2. In the illustrated embodiment 18" long by 0.062 diameter thick drill steel is used for rod 6. However, it should be noted that any number of materials could be suitable for the construction of rod 6 including various polymers. An acrylic cylinder is used for housing 12 as it is light weight, durable, and water resistant. Watertight end caps 39 (visible in FIG. 5), ensure no precipitation will reach either the motor 20 or the electronics 24.

A first aperture (not visible) resides through housing 12 for receipt of a two conductor stranded power wire 42. Power wire 42 has a first end adapted for connection with electronics 24, and a second end adapted for connection to a 12V AC/AC transformer 44 (although it is well known in the art that a comparable system could be devised that utilizes DC power). In order to secure a portion of the power wire 42 to rod 6, heat shrink tubing 46 is employed.

A second aperture (not visible) resides through housing 12 for receipt of an LED connection cable 48 (See FIG. 6), which has a first end adapted for connection with electronics 24, and a second end terminating in the 2-pin MTA Socket 8. LED connection cable 48 is comprised of 26 gauge 7/32 stranded wires, and secured to rod 6 via heat shrink tubing 46. For additional stability epoxy 40 envelops heat shrink tubing 46.

Figure 5:
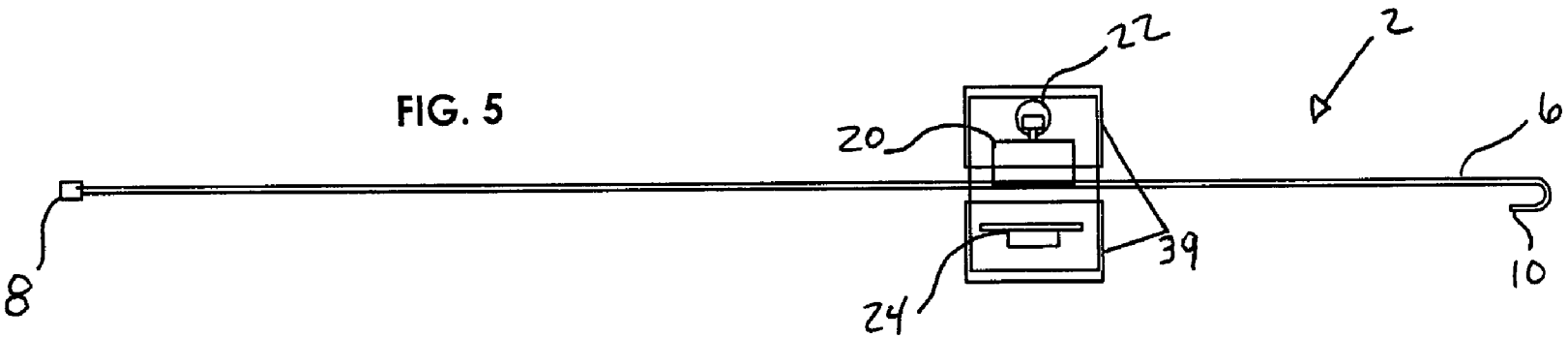
FIG. 5 is a top, cross-sectional view of an embodiment of the wand.
Figure 6:
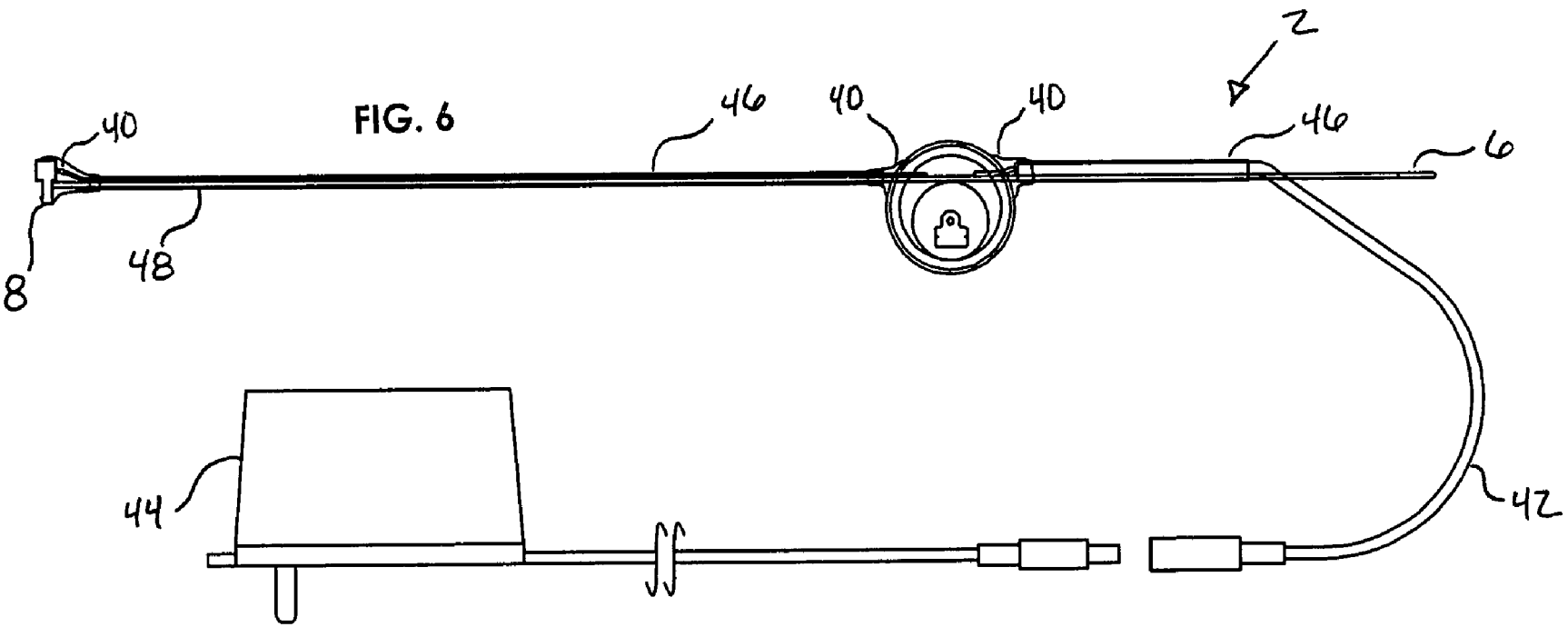
FIG. 6 is a side view of an embodiment of the wand with the water tight end cap removed for visual clarity.
Figure 12A:
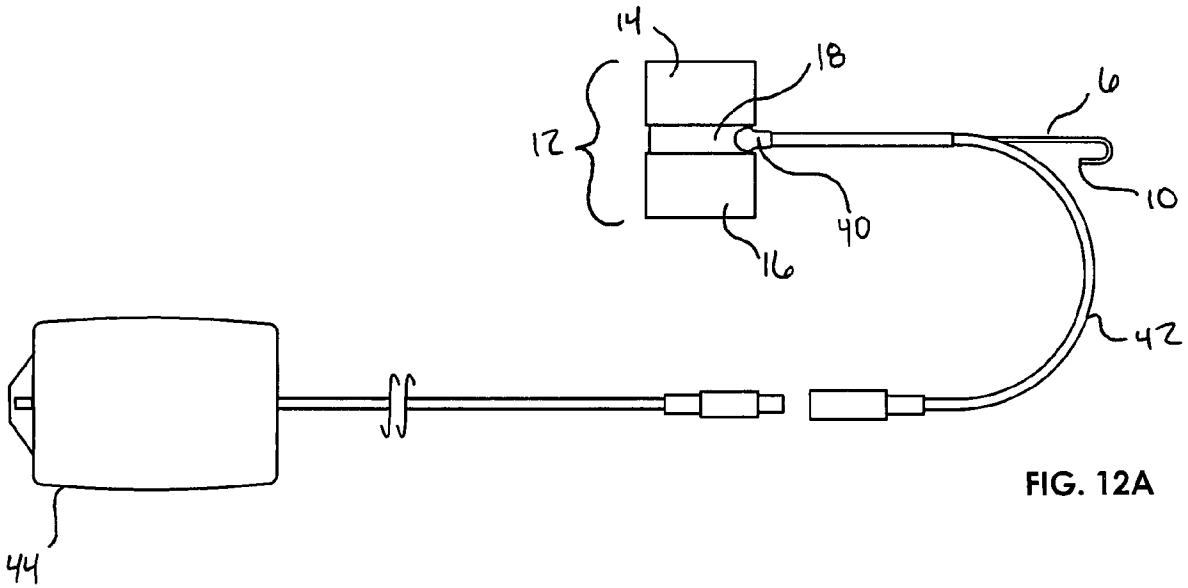
FIG. 12A is a top view of an alternate embodiment of the wand wherein the LED cluster depends directly from the housing.
Figure 12B:
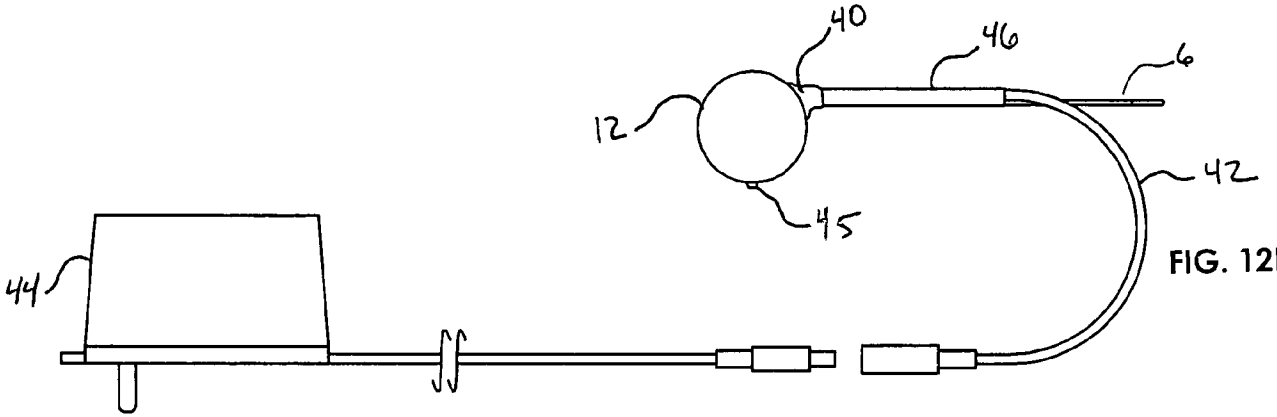
FIG. 12B is a side view of an alternate embodiment of the wand wherein the LED cluster depends directly from the housing.

Referring now to FIGS. 5-6, a motor 20 and eccentric weight 22 reside within first compartment 14. The mass of the offset weight (eccentric) causes the wand 2 to vibrate biaxially, when the motor 20 is running. Motor 20 is a DC motor with a recommended operating voltage of 6 volts. In this application it is driven with 0.5V to 1.5V to obtain a speed of 600 to 1800 RPM. If a motor whose recommended operating voltage is other that 6V is used, it would result in a range other that 0.5V to 1.5V to obtain the proper speed range. Motor 20 resides at approximately the ⅓ point along the longitudinal axis of rod 6 from mounting means 10, to minimize the vibration at the mounting point and maximize the vibration at the tip of rod 6 (i.e., the end of rod 6 terminating in electrical coupling 8). However, an alternate embodiment of the wand 2 is visible in FIGS. 12A and 12B, wherein the led cluster 32 extends directly from an LED cable socket 45 residing on housing 12.

Figure 7:
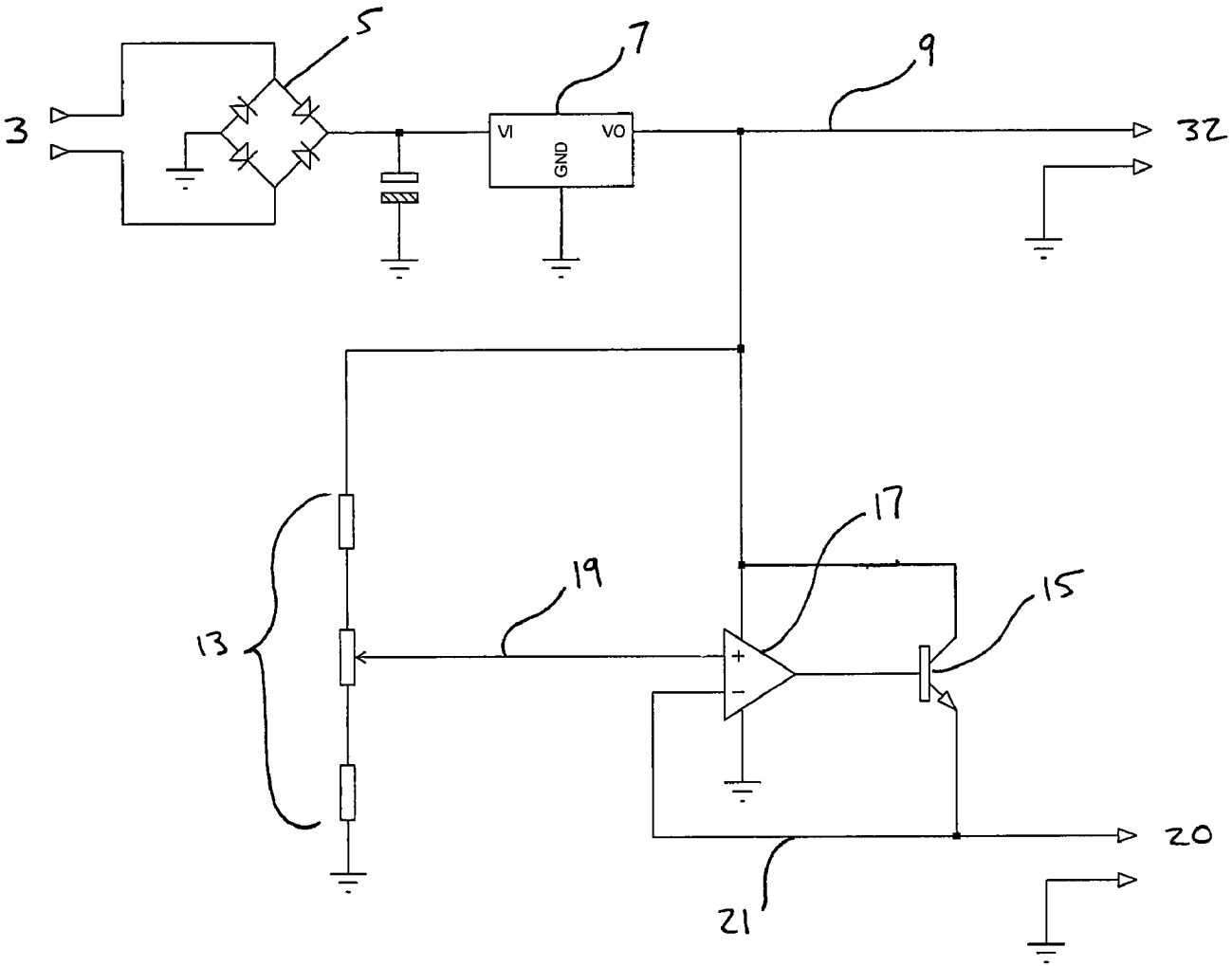
FIG. 7 is a diagram of a circuit embodying the principles of the invention.

Electronics 24, reside in second compartment 16, and FIG. 7 is a diagram of a circuit embodying the principles of the invention. Incoming power 3 is fed to the circuit board (not visible). Power 3 can be 11 to 25 volts AC or DC. Power 3 is rectified via a diode bridge 5 and regulated via a voltage regulator 7 to 9 volts DC. A first branch 9 of this 9 volt supply is sent out from the board to the LED cluster 32. A second branch 11 of the 9 volt supply is sent to potentiometer 13 to produce a manually adjusted low current set point 19 with a range of approximately 0.5 to 1.5 volts. This voltage range may change when using substitute motors. Potentiometer 13 passes low current which is well below that required to power motor 20. For example, potentiometer 13 can pass about 10 microamps and motor 20 consumes about 50 milliamps. To increase the current a Darlington transistor 15 is employed. Darlington transistor 15 is heat sensitive and will vary its output voltage with temperature changes. Located between the low current set point 19 and the Darlington transistor 15 is an operational amplifier 17, which compares the low current set point 19 with that of the output of the Darlington transistor 15, and is used to produce enough current to power motor 20 at the same voltage as the low current set point 19. Amplifier 17 will adjust the transistor's input to cause it to produce the proper high current set point voltage 21 over a wide temperature range, which is necessary for outdoor use of whimsical firefly simulation device 4.

Figure 8:
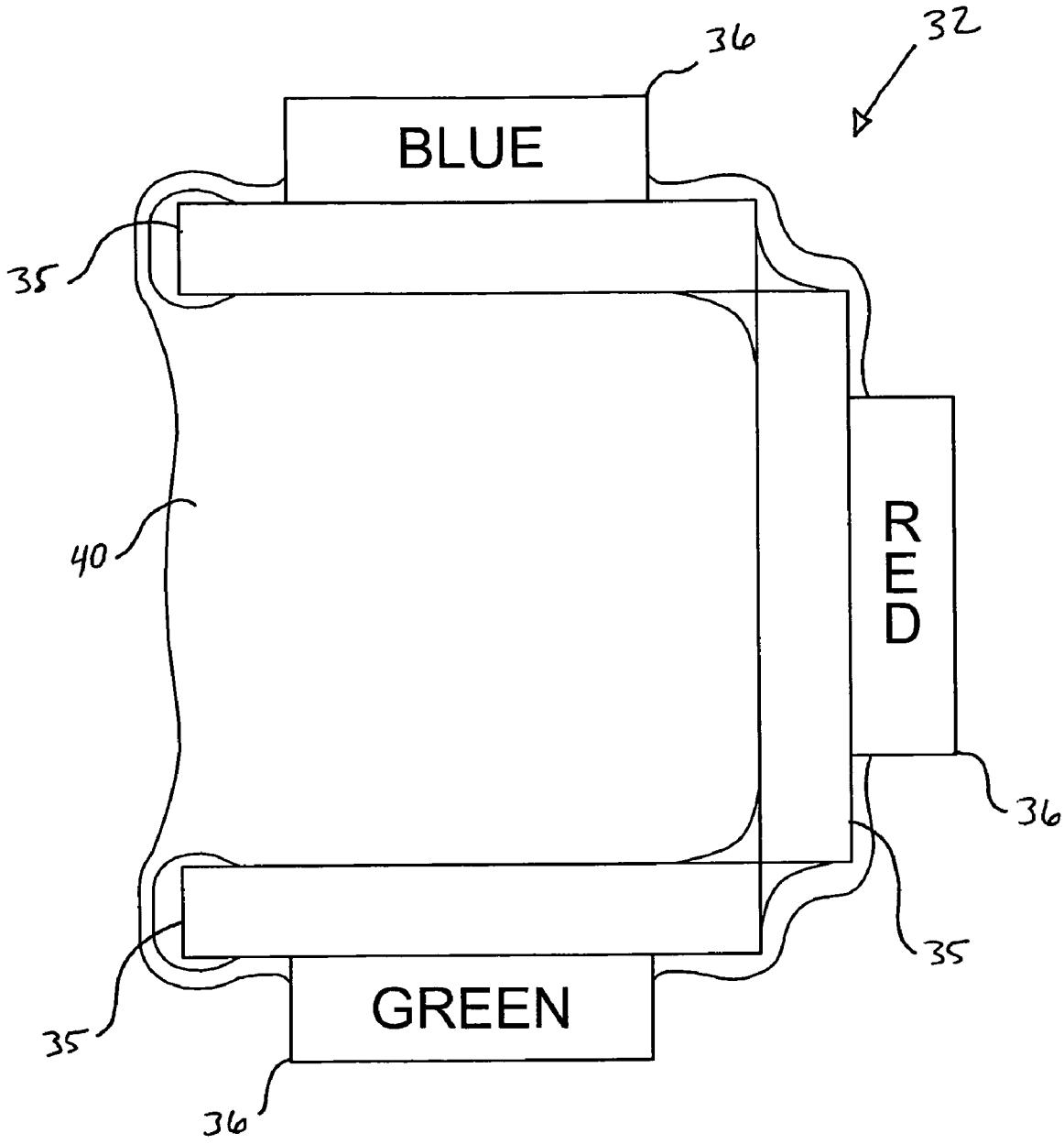
FIG. 8 is an enlarged top view of the LED cluster.
Figure 9:
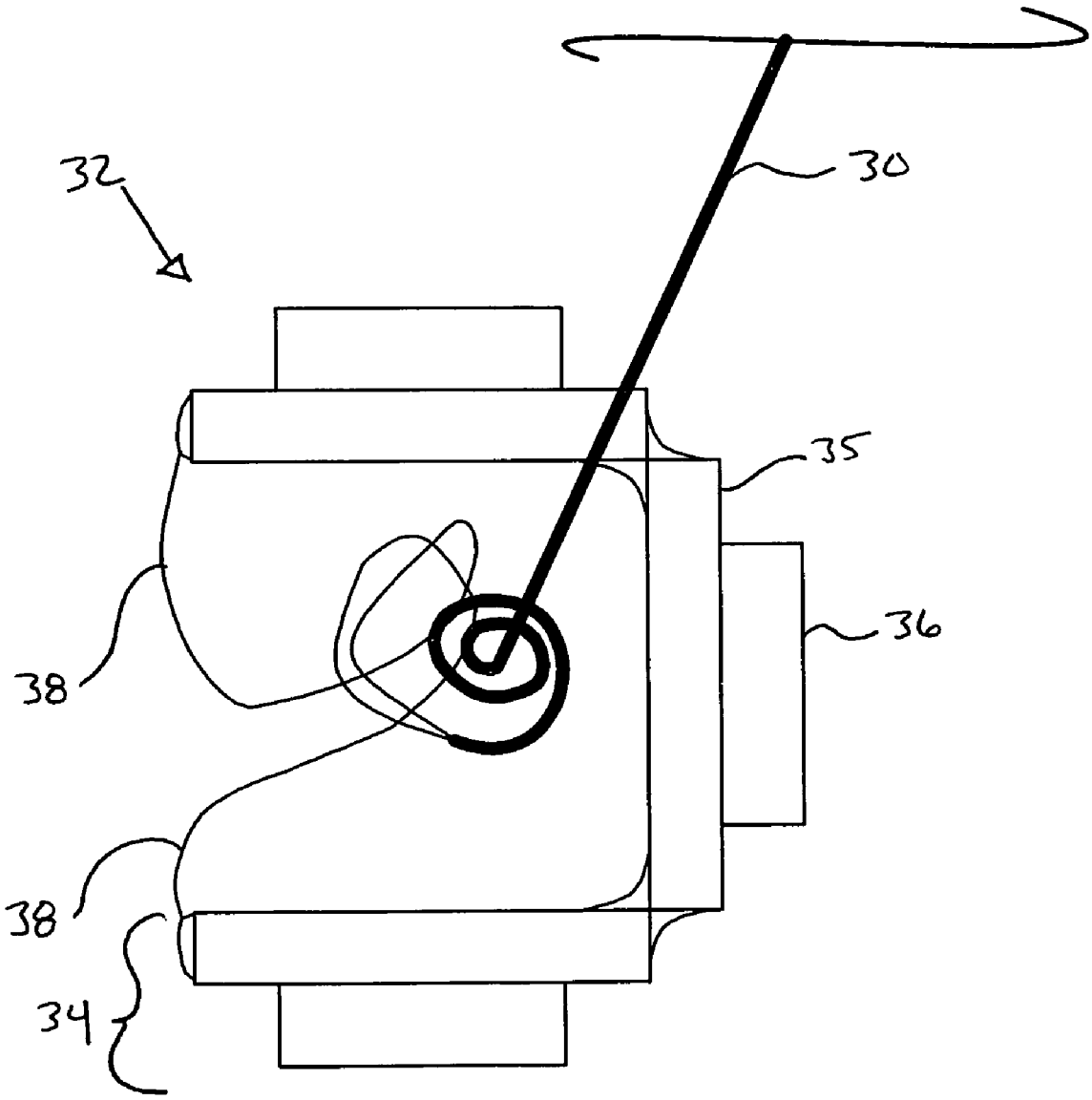
FIG. 9 is an enlarged top view of the LED cluster and LED cable.
Figure 13:
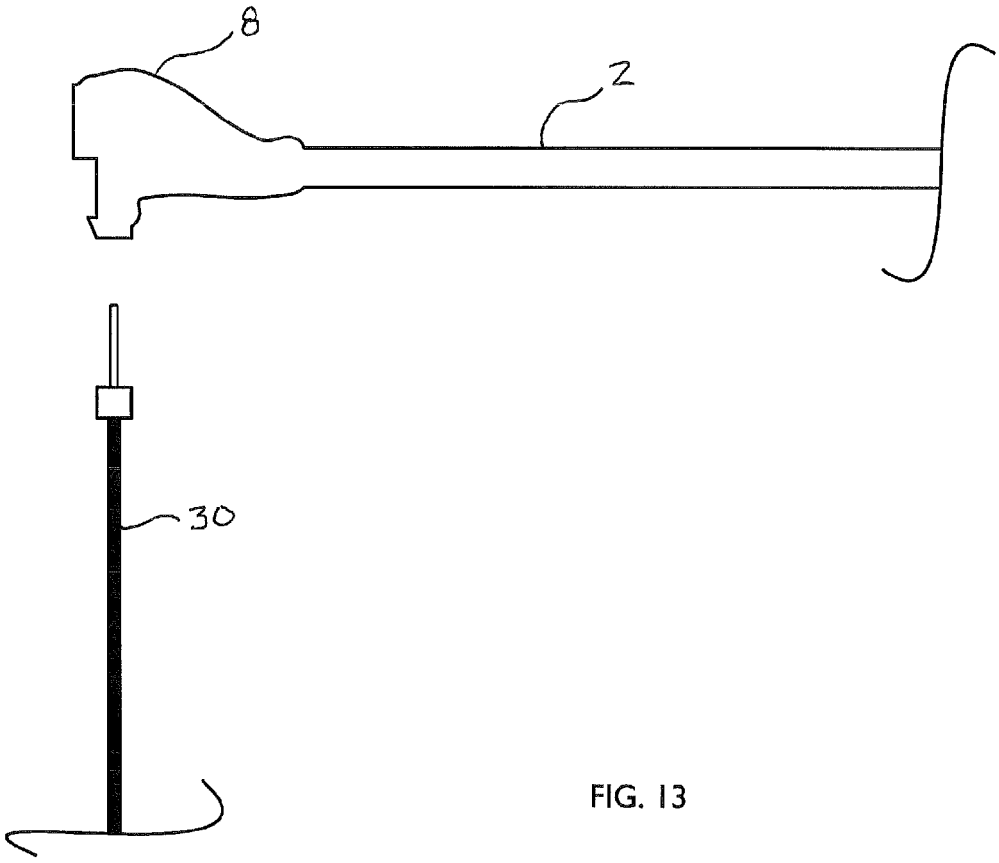
FIG. 13 is an enlarged partial side view; illustrating how the LED cable connects via a 2-pin MTA plug to wand via a 2-pin MTA socket.

Referring to FIGS. 8-9, LED cluster 32 is soldered to a LED cable 30, which comprises four 38 gauge enamel coated solid copper wires which have been spun together (two twisted pairs), and the opposite end of the cable is attached to a 2-pin MTA plug designed to matingly conform to MTA socket 8, illustrated in FIG. 13. Experimentation has shown that this level of wire protection is necessary to eliminate material fatigue of the LED cable given the strain it experiences. FIGS. 11A-11D illustrate how each of the two twisted pairs of wires 38 comprising LED cable 30 are soldered at the open-end of the body 35 of the blue LED 34 and at the open-end of the body 35 of the green LED 34. Looking at FIG. 9 It can be seen that wires 38 are then brought up through the center of the LED cluster 32 so as to extend normally from the LED cluster 32. Excluding the emitters 36 the LED cluster 32 and wires 38 are dipped in a polymer adhesive 40. Emitters 36 are not coated in polymer adhesive 40. The remaining portion of LED cable 30 is coated in a synthetic rubber coating.

Figure 10:
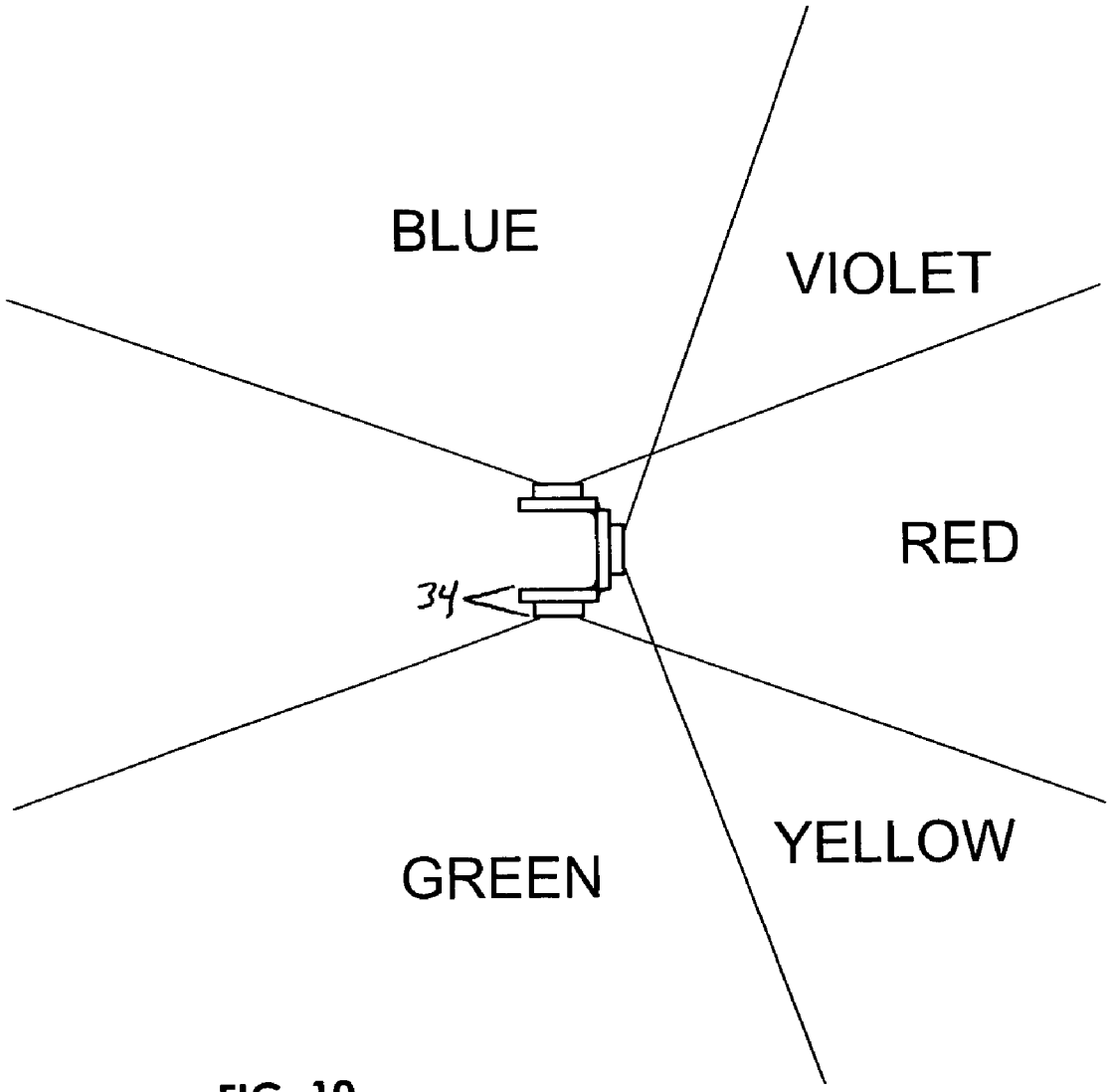
FIG. 10 is an illustration of the light pattern generated by the LED cluster.
Figure 11A:
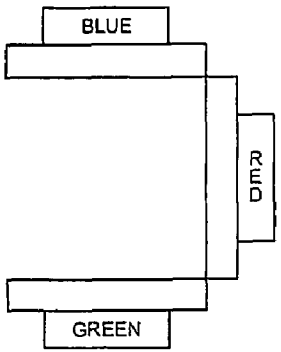
FIG. 11 A-D details the construction of the LED cluster.
Figure 11B:
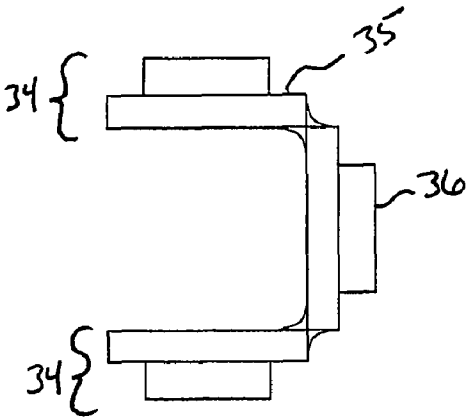
Figure 11C:
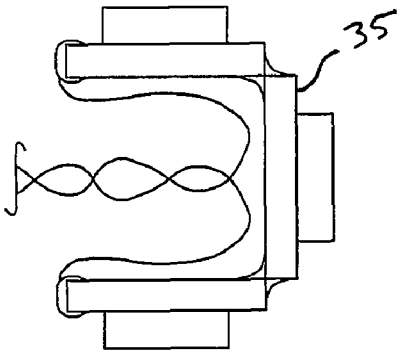
Figure 11D:
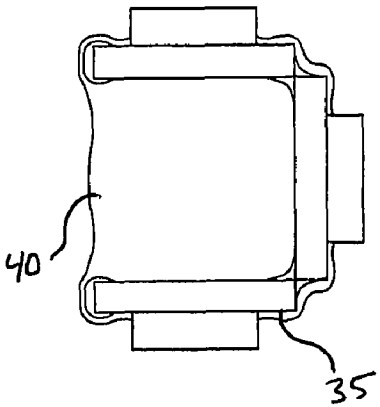

The LED cluster 32 comprises three LEDs 34 (one red, one green, and one blue) as is visible in FIG. 8. The LEDs 34 are comprised of a body 35 and an emitter 36, and are soldered at adjoining corners in an open-ended square configuration with the emitters facing out from the center of the open-ended square. LEDs 34 are arranged so that blue is opposite green and red is opposite the open side. Each emitter emits almost 180° of light, which produces an overlap of light colors at each soldered corner (violet at the corner of blue and red and yellow at the corner of red and green), which is illustrated in FIG. 10. In addition to green, yellow, red, violet, and blue light, the open-ended square configuration produces a twinkling white light which is a function of the LED cable's length and the motor speed.

As to not overpower the visual display produced by the LED cluster 32, the brightness of the blue LED is 200 micro-candles the red LED has a brightness of 800 micro-candles, and the green LED 400-600 micro-candles. Experimentation has shown that this combination results in a pleasingly aesthetic white light that twinkles and emanates colored rays.

Operation of the whimsical firefly simulation device 4 is achieved through powering electronics 24, preferably in a darkened environment. Wand 2 vibrates biaxially due to the eccentric weight 22 on motor 20. LED cluster 32 depending from LED cable 30 (or LED socket 35 in an alternate embodiment) will jerk and swing randomly, appearing to the observer as a confused, randomly convulsing, multi-colored light, and thus a whimsical simulation of the firefly is produced.

The above description will enable any person skilled in the art to make and use this invention. It also sets forth the best modes for carrying out this invention. There are numerous variations and modifications thereof that will also remain readily apparent to others skilled in the art, including using batteries or solar cells to power the whimsical firefly simulation device, providing a remote control for the operation of the whimsical firefly simulation device, or using a timer in conjunction with a light or motion sensor, now that the general principles of the present invention have been disclosed. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

What is claimed is:

1. A randomly fluttering LED apparatus comprising:

a rod with a first end and a second end, said first end terminating in a mounting provision and said second end terminating at a first electrical connection provision;

a motor with an eccentric weight attached;

an energizing circuit comprising a circuit board and a set of conductor wires;

a LED cluster; and an independent casing housing said motor and said circuit board, said casing including a two conductor stranded power wire having a first end adapted for connection with said circuit board, and a second end adapted for connection to a 12V power transformer, said casing further comprising a first aperture for receiving said power wire, wherein said casing further comprises a second aperture for receiving said set of conductor wires; wherein said set of conductor wires have a first end connected to said circuit board and a second end connected to said LED cluster;

wherein said housing is affixed to said rod along the midline of said housing at a point ⅓ of the total rod length of said rod, and a portion of said power wire and a portion of said set of conductor wires are affixed to said rod.

2. The apparatus of claim 1 wherein said LED cluster comprises at least two different colors of LEDs.

3. The apparatus of claim 1 wherein a visual display produced by said LED cluster comprises all of the individually distinct colors blue, violet, red, yellow, and green.

4. The apparatus of claim 1 wherein said LED cluster comprises one blue LED, one red LED, and one green LED.

5. The apparatus of claim 4 wherein said LED cluster is arranged to form an open-ended square configuration such that the light emitting portion of said blue LED, said red LED, and said green LED face out from the center of said square configuration.

6. The apparatus of claim 5 wherein said square configuration is further arranged such that said blue LED is opposite said green LED and said red LED is opposite the open end.

7. A light emitting apparatus comprising:

a rod with a first end and a second end;

a motor with an eccentric weight attached;

an LED cluster;

an LED energizing circuit functionally connected to said LED cluster and to said rod, said LED energizing circuit including a circuit board connected to said LED cluster by a set of conductors; and a housing including a first aperture for receiving a power wire, said motor and said circuit board are disposed in said housing, wherein said housing is affixed to said rod along the axial plane of said housing at a point ⅓ of the total rod length along a linear axis of said rod, said rod and said LED cluster are caused to vibrate by said motor such that LED cluster flutters randomly; and wherein said set of conductors comprises a PCB wire set and an LED wire set releaseably joined by a pair of first and second matingly conformed electrical connectors, and said housing further comprises a second aperture for receiving said PCB wire set, and wherein said PCB wire set has a first end adapted for connection with said circuit board and a second end terminating in said first connector.

8. The apparatus of claim 7 wherein said first end of said rod has a mounting provision and said second end of said rod terminates at said first connector.

9. The apparatus of claim 8 wherein said LED wire set has a first end connected to said LED cluster and a second end connected to said second connector.

10. The apparatus of claim 9 wherein said LED wire set is provided with a strain relief plastic coating; and wherein said PCB wire set is housed in heat-shrink tubing.

11. The apparatus of claim 10 wherein a portion of said PCB wire set and a portion of said power wire are affixed along a linear axis of said rod.

12. A randomly fluttering LED apparatus comprising:

a rod with a first end and a second end, said first end terminating in a mounting provision and said second end terminating at a first electrical connection provision;

a motor with an eccentric weight attached;

an energizing circuit comprising a printed circuit board electrically connected to a first and second LED connector cable;

a LED cluster comprising one red LED, one blue LED and one green LED arranged in an open-ended square configuration; and an independent housing formed so as to have a first half and a second half such that said motor resides in said first half of said housing and said circuit board resides in said second half, said housing including a two conductor stranded power wire having a first end adapted for connection with said circuit board, and a second end adapted for connection to a 12V power transformer, said housing further comprising a first aperture for receiving said power wire wherein said housing further comprises a second aperture for receiving said first LED connector cable, and wherein said housing is affixed to said rod along the midline of said housing at a point ⅓ of the total rod length of said rod, and wherein said first LED connector cable has a first end adapted for connection with said circuit board and a second end terminating in a first electrical connection provision and wherein said second LED connector cable has a first end and a second end wherein said first end terminates in said LED cluster and said second end terminates in a second electrical connection provision matingly conformed for electrical engagement with said first electrical connection provision, and wherein a portion of said power wire and said first LED connector cable is affixed to said rod.

* * * * *